US007980322B2

(12) United States Patent
Desmeules

(10) Patent No.: US 7,980,322 B2
(45) Date of Patent: Jul. 19, 2011

(54) IMPACT ADAPTER FOR A ROCK DRILL

(76) Inventor: Alain Desmeules, Montreal (CA)

( * ) Notice: Subject to any disclaimer, the term of this patent is extended or adjusted under 35 U.S.C. 154(b) by 303 days.

(21) Appl. No.: 12/341,084

(22) Filed: Dec. 22, 2008

(65) Prior Publication Data

US 2010/0155093 A1 Jun. 24, 2010

(51) Int. Cl.
*B25D 9/00* (2006.01)

(52) U.S. Cl. ..... 173/128; 173/90; 173/91; 173/129; 173/132

(58) Field of Classification Search ..... 173/128, 173/90, 91, 129, 132
See application file for complete search history.

(56) References Cited

U.S. PATENT DOCUMENTS 3,977,480 A * 8/1976 Hilding ..... 175/85
4,232,752 A * 11/1980 Hauk et al. ..... 175/135
4,296,821 A * 10/1981 Larson ..... 175/87
4,593,768 A * 6/1986 Eklof ..... 173/200
5,060,734 A * 10/1991 Anderson et al. ..... 173/128
5,310,014 A * 5/1994 Mueller ..... 175/171
5,549,170 A * 8/1996 Barrow ..... 175/55
6,089,330 A * 7/2000 Miescher et al. ..... 173/132

* cited by examiner

*Primary Examiner* — Brian D Nash
(74) *Attorney, Agent, or Firm* — Norton Rose OR LLP

(57) ABSTRACT

An impact adaptor to convert a rock drill to an impact driver is described. The impact adapter has a boom coupling for securing the adapter in co-operating alignment with the shank of a drifter. The adapter has a casing for slidingly receiving and guiding an anvil therein from a top open end of the casing. The casing has an open bottom end adapted for receiving a top end section of a pile, tube or rod in the casing. Anvil supports are provided in the casing for retaining the anvil captive therein in the absence of the top end section of the pile, tube or rod. The casing has a predetermined length above the anvil supports to permit captive displacement of the anvil and displacement of the top section of the pile, tube or rod therein. The impact adapter is secured to the drifter in a movable or immovable manner and compensates for wear of the shank.

18 Claims, 5 Drawing Sheets

IMPACT ADAPTER FOR A ROCK DRILL

TECHNICAL FIELD

The present invention relates to an impact adapter to convert a rock drill to a pile, tube or rod impact driver by using the shank of the drifter as a percussion transmitting means impacting on an anvil displaceably retained within a casing of the adapter.

BACKGROUND ART

The conventional manner of driving piles into the ground is to use very large cranes capable of lifting a large weight along a boom by the use of a cable with the weight being guidingly released along the boom. The boom is aligned with a pile to be driven into the ground with the pile having a connecting cap at a top end thereof usually supporting a large piece of wood to absorb sound and transfer the impact force of the weight when dropped along the boom by releasing the cable. Accordingly, this large weight applies a blow onto the connecting cap to provide one impacting force on the top end of the pile. Such conventional pile driving equipment is very noisy and time-consuming to install and operate. The impact force of the large weight also generates vibrations into the soil which are often felt in surrounding buildings. The pile driving process is also very slow due to the fact that a large weight needs to be raised along a boom and then released to free-fall onto the connecting caps secured to the top ends of the pile being driven. Transportation of these large cranes is also expensive.

Another type of pile driving device is the diesel hammer which also requires to be mounted on a boom and the hammer is positioned on top of a pile to be driven. A piston is actuated in the diesel hammer by explosions in a combustion chamber and it generates impact frequencies which are much superior to that of the large pile drivers above-described. A typical example of a diesel engine pile driving hammer is described in U.S. Pat. No. 4,497,376 where prior art problems of such hammers are described. Diesel pile driving hammers are also drop hammers which contact an anvil which is disposed in a connecting cap also seated on the top end of a pile to be driven. A large boom and hoist line is also required to hoist and release a ram from the hoist line to compress and heat entrapped air which has been captured within the piston cylinder casing between the ram and the handle and explode atomized diesel fuel which has been injected and mixed with the entrapped and compressed air. The explosion causes the hammer to apply blows onto the top of the pile. Diesel hammers are of less weight than the pile driver cranes described hereinabove but they provide more impact. They are also very noisy.

SUMMARY OF INVENTION

It is a feature of the present invention to provide an impact adapter to convert a rock drill to a pile, tube or rod impact driver and which substantially overcomes many of the above-mentioned disadvantages of the prior art.

Another feature of the present invention is to provide an impact adapter to convert a rock drill to an impact driver and wherein the pile driving is provided by the high frequency percussion movement of the shank of the drifter of the rock drill impacting onto an anvil displaceably retained within a casing of the impact adapter.

Another feature of the present invention is to provide an impact adapter to convert a rock drill to an impact driver and wherein the drifter of the rock drill is adapted to impart high frequency percussion movement only to the drill shank with the shank impacting on an anvil displaceably retained within a casing of the adapter and supported on the top end of a pile, tube or rod and wherein the casing is adapted to compensate for wear of the shank.

Another feature of the present invention is to provide an impact adapter to convert a rock drill to an impact driver, and which impact driver is easy to displace and position and which adapter provides for reduced equipment costs as compared to prior art pile driving equipment.

According to the above features, from a broad aspect, the present invention provides an impact adapter to convert a rock drill to an impact driver, the adapter comprises a casing for slidingly receiving and guiding an anvil therein, the casing having an open top end and an opening at a bottom end for receiving a top end portion of a pile, tube or rod therein, and attachment means to secure the adapter to securement means displaceable with a drifter of the rock drill.

According to a still further broad aspect, the present invention provides an impact adapter for an impact driver wherein the impact driver is a drifter connected to a rock drill and guidingly displaceable along a boom. The drifter is adapted to convert a rotational drive of the rock drill to a high frequency percussion movement of a shank thereof. Displacement means is provided to displace the drifter along the boom. The impact adapter comprises a boom coupling for securing the adapter in co-operating alignment with the shank. The adapter has a casing for slidingly receiving and guiding an anvil therein from a top open end thereof. The casing has an opening at a bottom end adapted for receiving a top end section of a pile, tube or rod in the casing. Anvil support means are provided in the casing to retain the anvil therein in the absence of the pile, tube or rod top end section. The casing has a predetermined length above the anvil support means to permit displacement of the anvil and the top section of the pile, tube or rod captive thereabove. Guide means is provided at the bottom end of the casing for guidingly positioning a free top end of the top end section of the pile, tube or rod in the opening at the bottom end of the casing to position the free top end of a face of the anvil.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
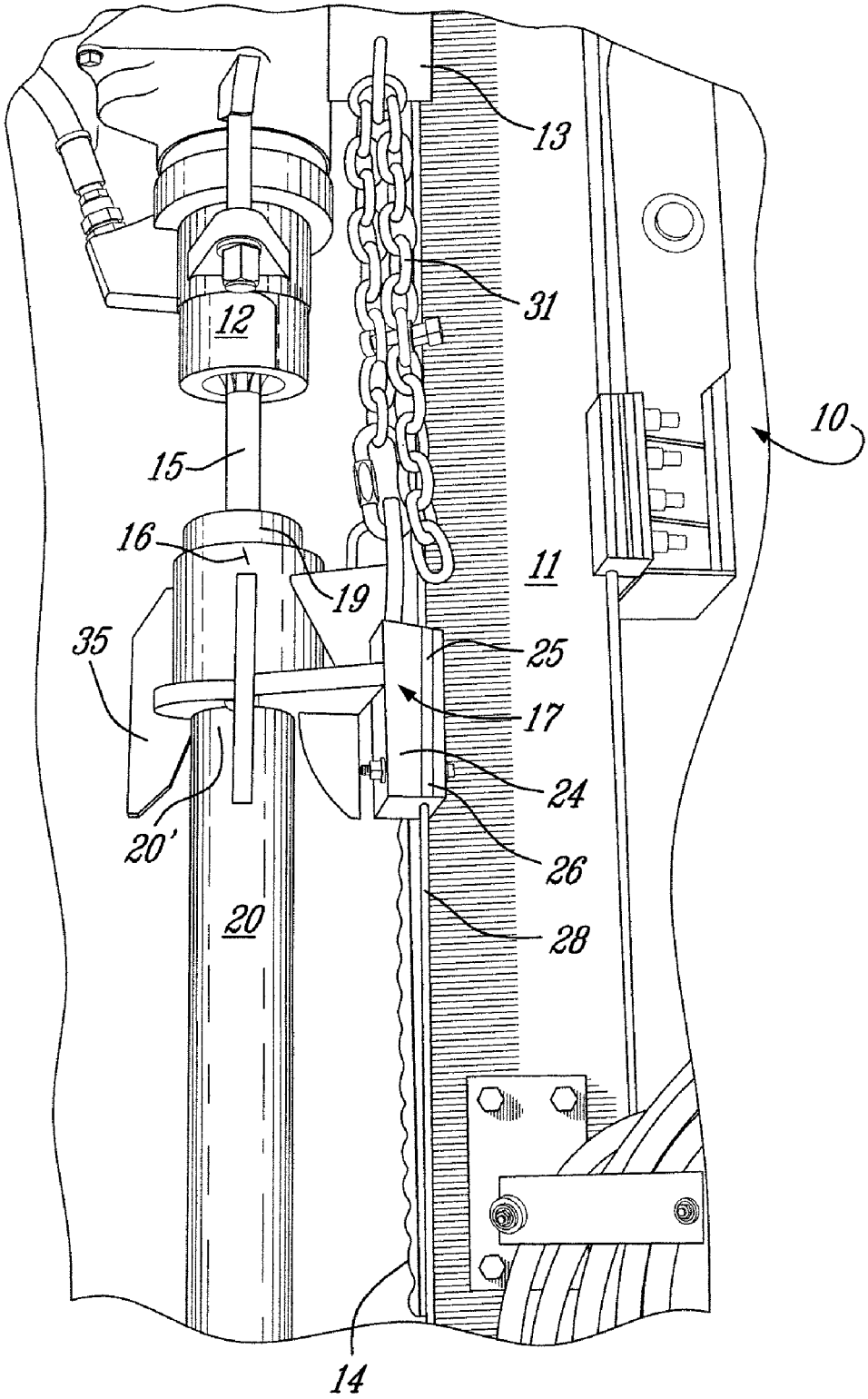
FIG. 1 is a perspective view of the impact adapter of the present invention shown slidingly secured to a boom of a rock drill having a drifter secured thereto with the shank of the drifter disposed on the anvil retained within the casing of the impact adapter.

Referring now to the drawings and more particularly to FIG. 1, there is shown generally at 10 a section of a rock drill. The rock drill comprises a boom 11 formed by a straight vertical steel beam secured to a vehicle, not shown but obvious to a person skilled in the art. A drifter 12 is secured to a carriage 13 guidingly displaceable along the boom 11 by a link chain 14 secured to a drive motor, not shown, whereby to apply a downward force on the carriage and consequently on the shank 15 of the drifter as is usual with rock drills to drill holes in rock. The drifter converts a rotational drive of the rock drill to a high frequency percussion movement on its drill shank 15. These hydraulic rock drill drifters are known in the art and have a hammer which operates at high frequency and generate about 150,000 lbs. of energy. An example of such drifter is the Doofor BF 751 hydraulic rock drill which is used for general excavations and underground production drilling. As hereinshown the impact adapter 16 of the present invention has a boom coupling 17 for securing the adapter 16 in co-operating alignment with the shank 15 of the drifter.

Figure 2:
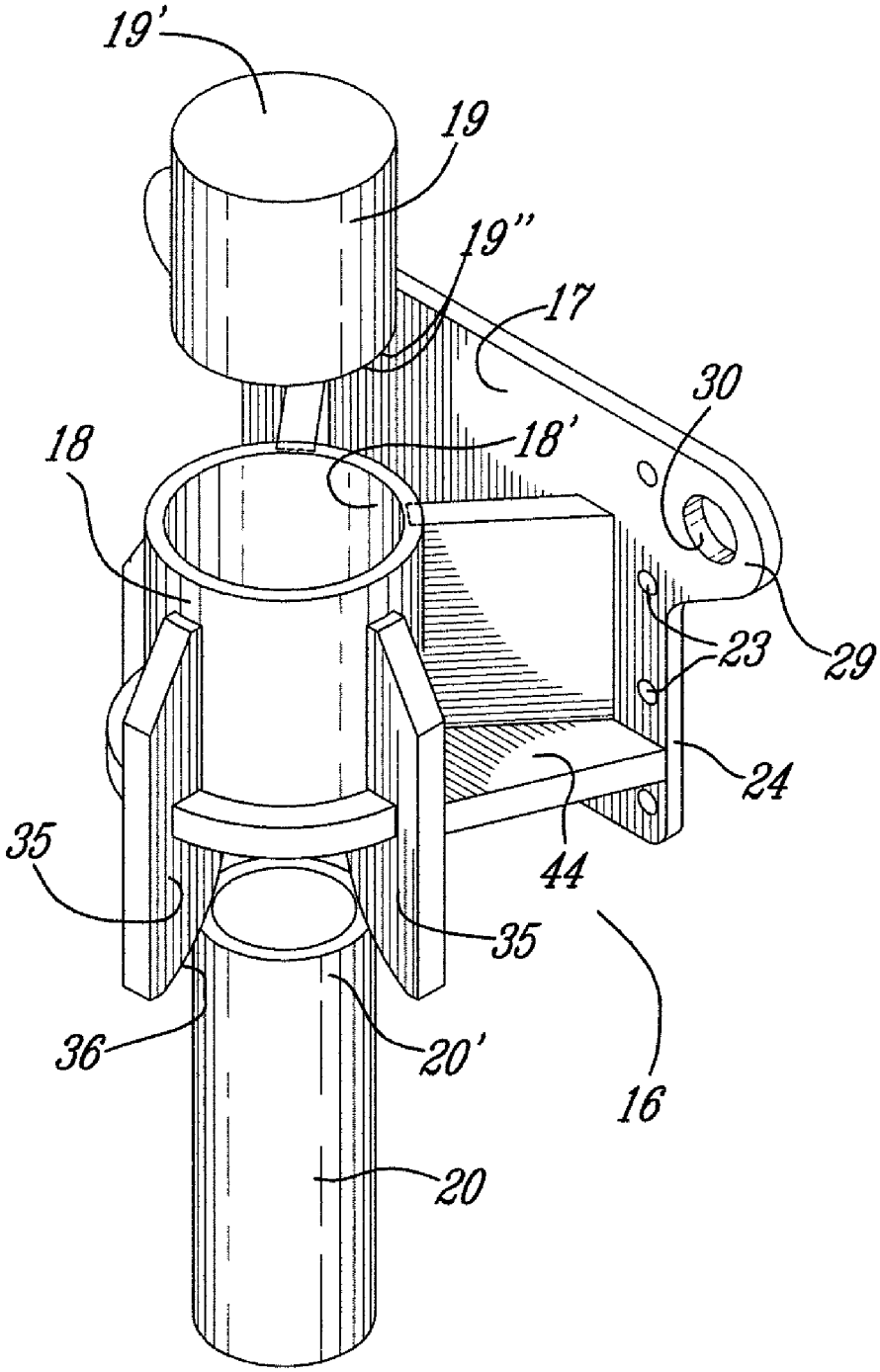
FIG. 2 is an exploded perspective view showing the impact adapter of the present invention with the anvil shown thereabove and a top section of a tubular pile shown positioned below the adapter in alignment with the casing and the anvil.
Figure 3:
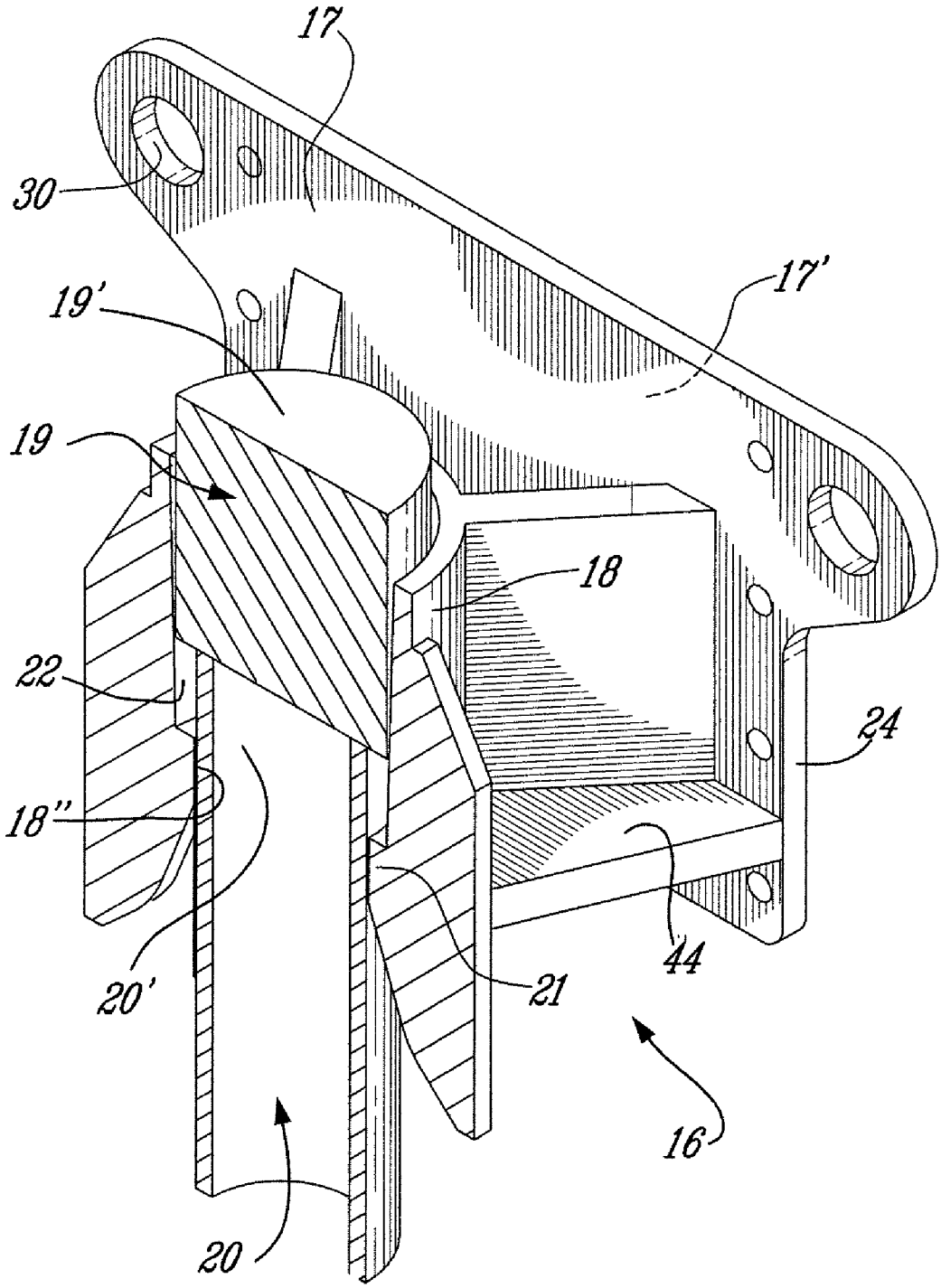
FIG. 3 is a section view of FIG. 2 but showing the tubular pile top section retained captive within the casing together with the anvil disposed on a top end of the pile top section.

With reference now to FIGS. 2 and 3, there will be described the detailed construction of the impact adapter 16. The adapter 16 is constructed of steel parts welded together and has a casing 18 which is hereinshown as being of tubular shape. The casing can also be formed by arcuate sleeve sections and may have a different cross-sectional shape depending on the cross-sectional shape of an anvil 19 to be received therein in close sliding fit. The anvil 19, as herein illustrated, is shaped as a solid steel disc of predetermined thickness and has opposed parallel top and bottom faces 19' and 19". Modifications of the anvil will be described later. As shown in FIG. 2 the anvil is received in the casing 18 from the top open end 18' of the casing.

Referring to FIGS. 2 and 3, the casing has an open bottom end 18" sized for receiving a top end section 20' of a tubular pile 20 (either hollow or solid and of any cross-section) or rod to be driven into the ground, herein a steel tube pile. The tube 20 is to be used as a pile or a geo-exchange conductor. Anvil support means, in the form of one or more projecting ridge formations 21, project inside the tubular casing 18 and are spaced from the open bottom end 18" in unobstructing relationship with the pile 20 to be received in the casing. The projecting ridge formations 21 support the anvil 19 in the tubular casing 18 when the impact adapter 16 is lifted along the boom 11, as shown in FIG. 1, whereby to secure a pile section on top of a pile section having been driven into the ground. The projecting ridge formation retains the anvil captive in the casing in the absence of the pile top end section being positioned within the casing. The casing has a side wall 22 which is of predetermined length to retain the anvil and the top end section of the pile as the pile is being driven into the ground by the shank of the drifter impacting at high frequency onto the anvil top wall. The shank generates approximately percussions per second on the top face 19' of the anvil.

Figure 4:
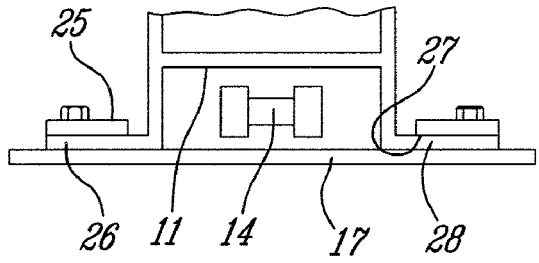
FIG. 4 is a simplified cross-section view showing the attachment support wall of the boom coupling secured to guide channel forming flanges forming opposed vertical channels slidingly attached to a respective one of opposed guide flanges of the boom of the rock drill.

As shown in FIGS. 2, 3 and 4, the boom coupling 17 is in the form of an attachment support flange or wall 17 provided with securement means in the form of holes 23 aligned in parallel relationship with the outer edges 24 of the support wall 17 for securement of a guide channel forming flange 25 thereto and spaced from the rear surface 17' of the wall 17 by a spacer flange 26 whereby to form a vertical channel 27 for sliding displacement along a respective one of opposed guide flanges 28 of the boom 11. The boom coupling wall 17 is also provided with ear formations 29 at opposed top ends thereof and having a hole 30 therein for the attachment of a chain 31 to provide a loose connection between the impact adapter 16 and the drifter 12. This loose coupling is to provide for wear in the shank 15. In a further embodiment as will be described with reference to FIG. 6, the impact adapter may be immovably secured to the carriage 13 of the drifter 12 with the compensation for the wear of the shank 15 being provided by the length of the casing 18 permitting displacement of the anvil and the top end of the pile.

As also shown in FIGS. 1 to 3, the impact adapter is further provided with guide means constituted by two or more spaced apart guide flanges 35 secured about the open bottom end 18" of the casing 18 and having outwardly extending guide edges 36 to guide the top end section 20' of the pile 20 in the open bottom end 18" of the casing whereby to axially align the pile with the anvil 19 and the shank 15 of the drifter. Such is important when connecting a pile section to a pile section already driven into the ground as these piles have a length of approximately 20 feet. Accordingly, the drifter and the impact adapter is retracted upwardly along the boom by the link chain 14 to a position approximately 25 feet in height and then brought down on the top end section 20' of the pile which extends at least 20 feet high with a person guiding the pile section into the area between the guide flanges and the guide flanges position the pile top end section 20' within the casing 15 as the adapter 16 is brought down by the operator on the top end of the pile with the anvil in contact with the pile and the shank resting on top of the anvil to retain the anvil within the casing.

Figure 5:
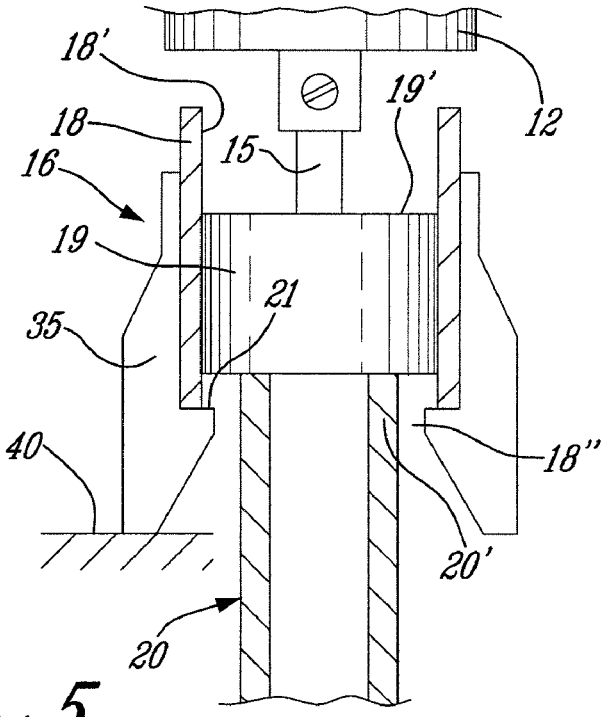
FIG. 5 is a section view showing an embodiment where the impact adapter is independently displaceable with respect to the drifter to compensate for wear in the shank of the drifter.

As previously described the chain 31 provides a loose connection between the impact adapter 16 and the drifter 12 and this compensates for wear in the steel shank 15 and such is illustrated in FIG. 5 wherein it is shown that the shank 15 has worn-down to a very short length after multiple uses applying percussion strokes against the top face 19' of the anvil 19. Because of this loose connection it is possible for the drifter to move closer to the impact adapter a limited distance while retaining the anvil captive. The chain length is selected to prevent the anvil 19 from moving completely out of the casing 18. As also shown in FIG. 5 when the pile 20 is driven close to the ground surface 40 the guide flanges 35 of the impact adapter 16 will first rest onto the ground surface 40 and the drifter will continue to reciprocate the shank 15 until the anvil 19 is close to the projecting ridge formations 21 of the flanges 35 with only a short portion of the driven pile section 20 extending from above the ground ready to receive a connector therein, such as the connector described in my U.S. patent application Ser. No. 11/520,597, filed Sep. 14, 2006, and entitled "Hollow Pipe Connector", whereby to connect the bottom end of another pile section thereon after the drifter and the impact adapter have been retracted up the boom a distance sufficient to clear the pile section to be connected thereto.

Figure 6:
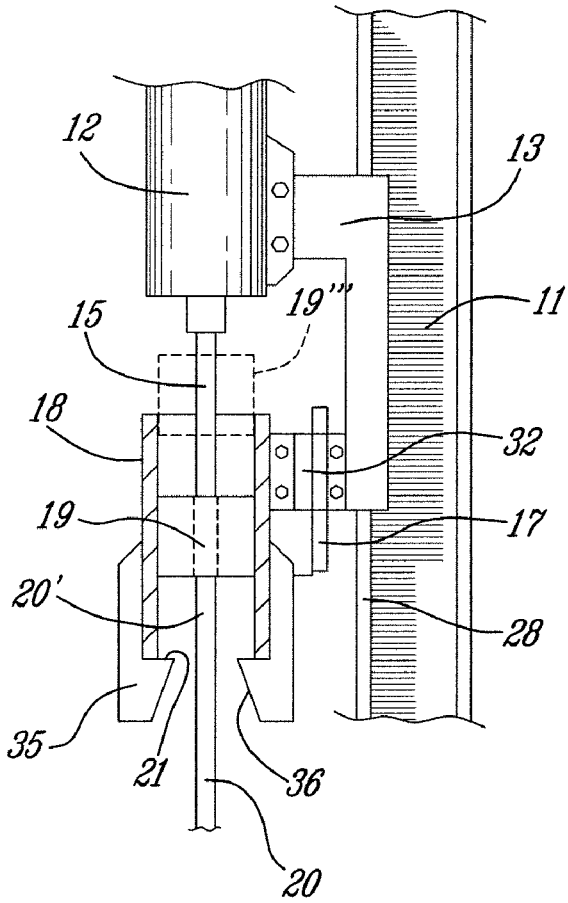
FIG. 6 is a simplified and partly sectioned side view showing the impact adapter immovably secured to the carriage of the drifter and with the length of the casing providing for displacement of the anvil therein to compensate for wear in the shank of the drifter.

As shown in FIG. 6 the attachment means for connecting impact adapter to the drifter carriage 13 is provided by an immovable connection 32 between the boom coupling 17, or an alternate coupling, and the carriage 13. Accordingly, the impact adapter 16 is displaceable with the drifter in fixed relationship thereto. In such an arrangement the casing 18 is made of a predetermined length above the support projecting ridge formations 21 permitting upward movement of the anvil 19 which sits on the pile upper end 20' and the length of the casing compensates for the wear in the length of the shank 15, as hereinshown. As the shank 15 wears down, the anvil 19 will move upward in the casing 18, as hereinshown in phantom lines at 19''' and as well the pile upper end 20' also moves up within the casing. When the shank is worn-down to a very short length, the anvil is still retained captive within the upper end portion of the casing.

Figure 7:
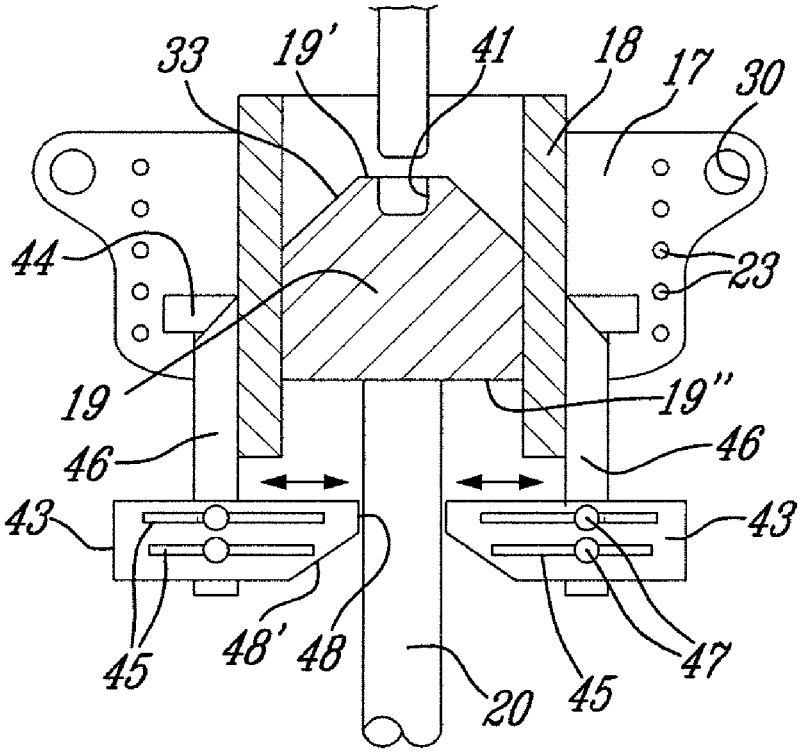
FIG. 7 is a simplified side view showing modifications to the guide flanges of the adapter casing as well as modifications to the anvil whereby to adapt to piles, tubes or rods of different diameters.

FIG. 7 shows modifications of the anvil 19 and the projecting ridge formations 21 of the impact adapter. As hereinshown the anvil 19 is provided with a cavity 41 in its top face 19'. This cavity 41 is sized to receive the free end of the shank in guided captive alignment therewith and this reduces wear in the shank end which would otherwise sway on the top surface 19' of the anvil. Also, the anvil 19 has a conical top wall 33 to concentrate the energy downwardly towards the top end wall 34 of the pile 20.

As also shown in FIG. 7, the guide means or projecting ridge formations 21 are herein constituted by adjustable guide flanges 43 which are spaced apart from one another, there being two or more of these guide flanges 43 secured to supports 46 secured to the bottom end portion of the casing 18. These adjustable flanges 43 are provided with one or more slots 45 which are secured to the supports 46 and retained captive by fasteners, herein bolt fasteners 47 whereby to position the tapered inner flange edges 48 spaced apart a predetermined distance to receive piles 20 of different diameters whereby the piles can be centered onto the bottom surface 19" of the anvil 19 by their tapered lower edge sections 48'.

Figure 8:
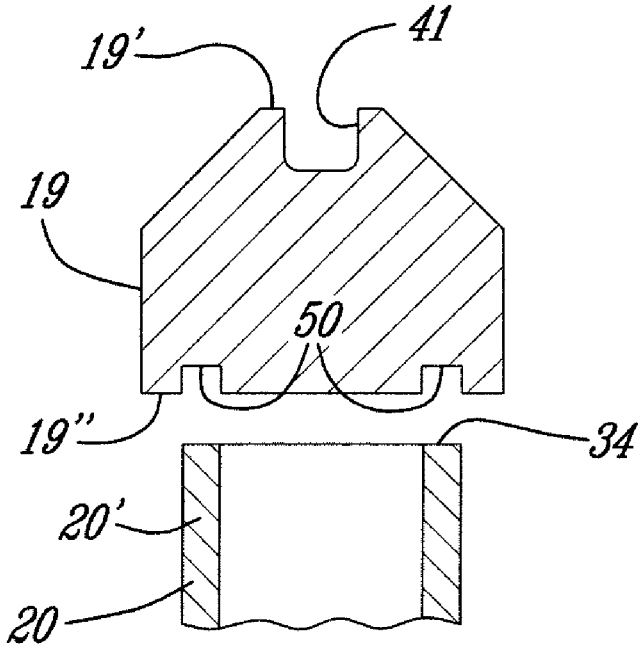
FIG. 8 is a simplified section view showing a further modification of the anvil.

FIG. 8 shows a further modification of the anvil 19 wherein a cavity 50, herein an annular cavity is provided in the bottom face 19" of the anvil to receive therein the top end wall 34 of the pile 20 to prevent flaring of the pile end 34 hindering the interconnection between piles, particularly if the connection is a thread connection. This annular cavity 50 also stabilizes the pile with respect to the anvil and the shank 15 and maintains them on a substantially straight vertical axis. The piles 20 may be hollow metal pipes as hereinshown or they could be solid metal rods which are used to position anchors within the soil or for other use. They could also be concrete piles or any other type of pile intended to be driven within the soil.

It can be appreciated that by providing the impact adapter of the present invention to convert a rock drill to a pile driving machine that great economies are achieved while providing a machine that is easy to maneuver into restrained areas, such as in a foundation hole and which is less noisy as compared to large pile driving equipment.

The preferred embodiment described herein as well as some of its modifications are not intended to be limiting and it is within the ambit of the present invention to cover any obvious modifications of the impact adapter provided such modifications fall within the scope of the appended claims.

I claim:

1. An impact adapter for an impact driver wherein said impact driver comprises a drifter connected to a rock drill and guidingly displaceable along a boom, said drifter being adapted to convert a rotational drive of said rock drill to a high frequency percussion movement of a shank thereof, displacement means to displace said drifter along said boom, said impact adapter comprising a boom coupling for securing said adapter in co-operating alignment with said shank, said adapter having a casing for slidingly receiving and guiding an anvil therein from a top open end thereof, said anvil being a solid steel mass, said casing having an opening in a bottom end adapted for receiving a top end section of a pile, tube or rod in said casing, anvil support means in said casing to retain said anvil therein in the absence of said top end section of said pile, tube or rod, said casing having a predetermined length above said anvil support means to permit displacement of said anvil and said top section of said pile, tube or rod captive thereabove, and guide means at said bottom end of said casing for guidingly positioning a free top end of said top end section of the pile, tube or rod in said opening at said bottom end of said casing to position said free top end on a bottom face of said anvil.

2. An impact adapter for a rock drill as claimed in claim 1 wherein said boom coupling comprises attachment means to secure said impact adapter to securement means displaceable with said drifter.

3. An impact adapter for a rock drill as claimed in claim 2 wherein said boom coupling is slidingly secured to said boom, said attachment means being a loose attachment means secured to said boom coupling and to a carriage to which said drifter is attached to permit independent displacement of a free impacting end of said shank with respect to a top face of said anvil to compensate for wear of the length of said shank.

4. An impact adapter for a rock drill as claimed in claim 3 wherein said loose attachment means is a chain connection between said boom coupling and said carriage of said drifter, said carriage constituting said securement means displaceable with said drifter, said chain having a length sufficient to compensate for the total wear of said shank.

5. An impact adapter for a rock drill as claimed in claim 2 wherein said attachment means is an immovable connection to secure said impact adapter to a carriage to which said drifter is attached, said carriage constituting said securement means displaceable with said drifter, said predetermined length of said casing above said anvil support means permitting upward movement of said anvil sitting on said pile upper end to compensate for wear of the length of said shank.

6. An impact adapter for a rock drill as claimed in claim 1 wherein said guide means is constituted by two or more spaced-apart guide flanges secured about said bottom end of said casing and having outwardly extending guide edges to guide said top end section of the pile, tube or rod in said opening at said bottom end of said casing for axial alignment of said pile, tube or rod with said shank.

7. An impact adapter for a rock drill as claimed in claim 1 wherein said guide means is an adjustable guide means for guidingly positioning piles, tubes or rods of different diameters in said opening at said bottom end of said casing for axial alignment of said piles, tubes or rods with said shank.

8. An impact adapter for a rock drill as claimed in claim 7 wherein said adjustable guide means is constituted by two or more spaced apart guide flanges having tapered inner flange edges for guiding said top end section of said pile, tube or rod in said opening at said bottom end of said casing, and adjustable positioning means securing each said guide flanges to said casing for adjusting the position of said tapered inner flange edges.

9. An impact adapter for a rock drill as claimed in claim 1 wherein said casing is a tubular casing, said anvil having a cross-sectional shape for close sliding fit within said tubular casing.

10. An impact adapter for a rock drill as claimed in claim 9 wherein said anvil support means is provided by one or more projecting ridge formations extending inside said tubular casing from an inner surface of said tubular casing and spaced from said bottom end and in unobstructing relationship with the pile, tube or rod to be received therein, said one or more projecting ridge formations supporting said anvil in said tubular casing when said impact adapter is lifted along said boom.

11. An impact adapter for a rock drill as claimed in claim 9 wherein said anvil has a top face provided with a cavity therein adapted to receive a free end of said shank in guided captive alignment therewith to reduce wear of said shank.

12. An impact adapter for a rock drill as claimed in claim 9 wherein said anvil has a flat horizontal bottom face provided with a cavity configured to guidingly receive in close fit a free top end of the pile, tube or rod therein to reduce wear at said top end of the pile, tube or rod.

13. An impact adapter for a rock drill as claimed in claim 12 wherein said pile, tube or rod is a hollow tubular pipe, said cavity being an annular cavity to prevent flaring of said free top end of the tubular pipe, said tubular pipe being hollow tubular pipe.

14. An impact adapter for a rock drill as claimed in claim 1 wherein said displacement means is a driven sprocket chain secured to a carriage to which said drifter is attached and to drive means to displace said drifter up and down along said boom, said drive means applying a downward force on said drifter for translation on said shank to apply a high frequency downward driving force percussion on a top face of said anvil.

15. An impact adapter for a rock drill as claimed in claim 1 wherein said boom coupling is an attachment support wall, securement means at opposed parallel edges of said support wall for securement of a guide channel forming flange thereto to form opposed facing vertical channels for sliding displacement along a respective one of opposed guide flanges of said boom.

16. An impact adapter for a rock drill as claimed in claim 1 wherein said shank is a rigid metal drill shank, said pile, tube or rod is one of a metal pipe, a metal rod or a concrete pile.

17. An impact adapter for a rock drill as claimed in claim 1 wherein said anvil is a solid steel disc of predetermined thickness and having opposed parallel top and bottom faces, said top face having a conical shape with a flat top apex wall adapted to receive an impacting free end of said shank thereon.

18. An impact adapter for an impact driver equipped with a drifter connected to a rock drill to convert a rotational drive of said rock drill to a high frequency percussion movement of a shank thereof, said adapter comprising a casing for slidingly receiving and guiding an anvil therein, said anvil being a solid steel mass, said casing having an open top end and an opening at a bottom end for receiving a top end portion of a pile therein, attachment means to secure said adapter to securement means displaceable with said drifter, guide means at said bottom end of said casing for guidingly positioning said top end portion of said pile, tube or rod, said casing has a predetermined length to retain the anvil therein as said anvil is displaced longitudinally in said casing in contact between a free top end of the pile, tube or rod and a free end of said shank of the drifter to compensate for wear of the shank due to high frequency reciprocation of the shank on a top face of the anvil.

* * * * *